US006217467B1

(12) United States Patent
Maleski

(10) Patent No.: US 6,217,467 B1
(45) Date of Patent: Apr. 17, 2001

(54) BROADHEAD FOR AN ARROW HAVING EXPANDING CUTTING BLADES

(75) Inventor: Richard C. Maleski, Plymouth, CT (US)

(73) Assignee: Wasp Archery Products, Inc., Plymouth, CT (US)

( * ) Notice: Subject to any disclaimer, the term of this patent is extended or adjusted under 35 U.S.C. 154(b) by 0 days.

(21) Appl. No.: 09/477,031

(22) Filed: Jan. 3, 2000

(51) Int. Cl.[7] ..... F42B 6/08
(52) U.S. Cl. ..... 473/583; 473/584
(58) Field of Search ..... 473/583, 584

(56) References Cited

U.S. PATENT DOCUMENTS

| | | | |
|---|---|---|---|
| D. 232,731 | 9/1974 | Altier | D22/115 |
| D. 279,813 | 7/1985 | Palizzolo | D22/115 |
| D. 342,303 | 12/1993 | Johnson | D22/115 |
| 1,222,142 | 4/1917 | Rossi | 102/436 |
| 1,318,858 | 10/1919 | Frick | 102/400 |
| 2,289,284 | 7/1942 | Chandler | 473/584 |
| 2,568,417 | 9/1951 | Steinbacher | 473/583 |
| 2,820,634 | 1/1958 | Vance | 473/583 |
| 2,859,970 | 11/1958 | Doonan | 473/583 |
| 2,939,708 | 6/1960 | Scheib | 473/582 |
| 2,993,697 | 7/1961 | Urban | 473/583 |
| 3,036,396 | 5/1962 | Swails | 43/6 |
| 3,138,383 | 6/1964 | McKinzie | 473/583 |
| 3,241,836 | 3/1966 | Zwickie | 473/582 |
| 3,578,328 | 5/1971 | Rickey | 473/583 |
| 3,586,332 | 6/1971 | Alban | 473/578 |
| 3,600,835 | 8/1971 | Hendricks | 43/6 |
| 3,759,519 | 9/1973 | Palma | 473/578 |
| 4,099,720 | 7/1978 | Zeren | 473/584 |
| 4,166,619 | 9/1979 | Bergmann et al. | 473/584 |
| 4,175,749 | 11/1979 | Simo | 473/584 |
| 4,210,330 | 7/1980 | Kosbab | 473/584 |
| 4,381,866 | 5/1983 | Simo | 473/584 |
| 4,452,460 | 6/1984 | Adams | 473/584 |
| 4,558,868 | 12/1985 | Musacchia | 473/584 |
| 4,565,377 | 1/1986 | Troncoso, Jr. et al. | 473/584 |
| 4,579,348 | 4/1986 | Jones | 473/583 |
| 4,615,529 | 10/1986 | Vocal | 473/583 |
| 4,621,817 | 11/1986 | Musacchia | 473/583 |
| 4,807,382 | 2/1989 | Albrecht | 43/6 |
| 4,905,397 | 3/1990 | Juelg, Jr. | 43/6 |
| 4,932,671 | 6/1990 | Anderson, Jr. | 473/583 |
| 4,940,246 | 7/1990 | Stagg | 473/583 |
| 4,976,443 | 12/1990 | DeLucia | 473/583 |
| 4,998,738 | 3/1991 | Puckett | 473/583 |
| 5,046,744 | 9/1991 | Eddy | 473/583 |
| 5,066,021 | 11/1991 | DeLucia | 473/583 |
| 5,078,407 | 1/1992 | Carlston et al. | 473/583 |
| 5,082,292 | 1/1992 | Puckett et al. | 473/583 |
| 5,083,798 | 1/1992 | Massay | 473/583 |

(List continued on next page.)

*Primary Examiner*—John A. Ricci
(74) *Attorney, Agent, or Firm*—Dilworth & Barrese, LLP

(57) ABSTRACT

A broadhead for an arrow having a reduced amount of interference in the pivotal range of travel of the cutting blades, thereby allowing the cutting blades to pivot to a predetermined deployed position. The broadhead generally includes a body portion having a circular cross-section and defining a proximal end and a distal end, a post member extending from the proximal end having an outer diameter less than an outer diameter of the body portion, a pointed tip at the distal end of the body portion, at least one cutting blade secured to the body portion and configured to be movable from a retracted position to an expanded position; and a washer configured to be positioned over the post member and adjacent the outer peripheral surface, the washer having at least one chamfer formed thereon. An elastic ring may be provided around the cutting blades to maintain the cutting blades in an undeployed, retracted position. The retracted blade assembly may also be fixedly secured to enable the user to utilize the broadhead as a target point.

17 Claims, 5 Drawing Sheets

U.S. PATENT DOCUMENTS

| | | | |
|---|---|---|---|
| 5,090,709 | 2/1992 | Johnson | 473/584 |
| 5,100,143 | 3/1992 | Puckett | 473/583 |
| 5,102,147 | 4/1992 | Szeluga | 473/584 |
| 5,112,063 | 5/1992 | Puckett | 473/583 |
| 5,178,398 | 1/1993 | Eddy | 473/583 |
| 5,314,196 | 5/1994 | Ruelle | 473/578 |
| 5,322,297 | 6/1994 | Smith | 473/583 |
| 5,354,068 | 10/1994 | Maleski | 473/584 |
| 5,417,440 | 5/1995 | Barrie et al. | 473/584 |
| 5,458,341 | 10/1995 | Forrest et al. | 473/583 |
| 5,472,213 | 12/1995 | Dudley | 473/583 |
| 5,478,089 | 12/1995 | Austin | 473/582 |
| 5,482,293 | 1/1996 | Lekavich | 473/584 |
| 5,879,252 | 3/1999 | Johnson | 473/583 |

Fig. 5
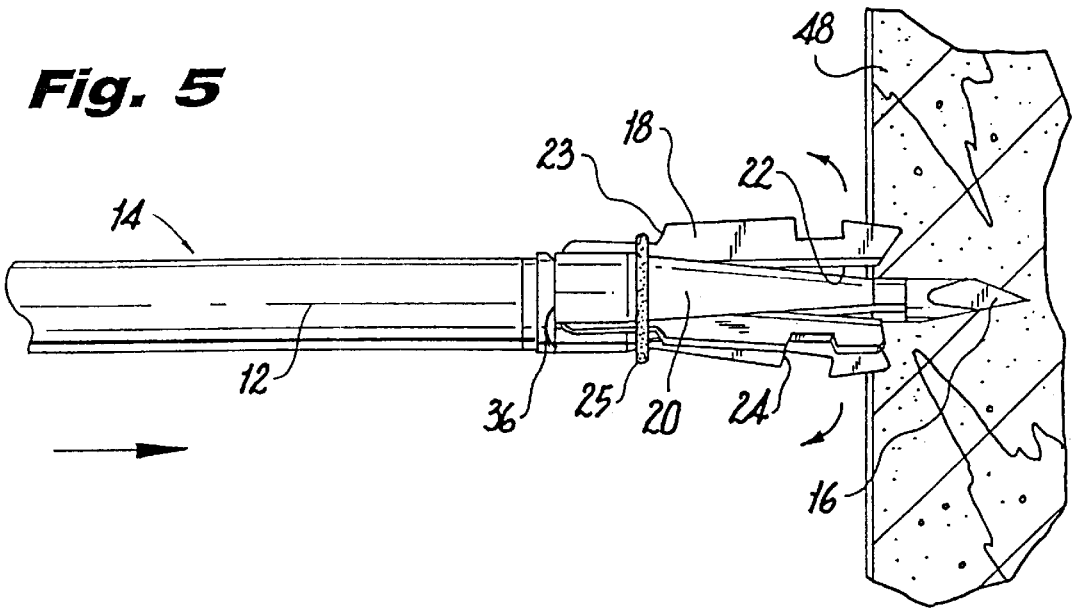
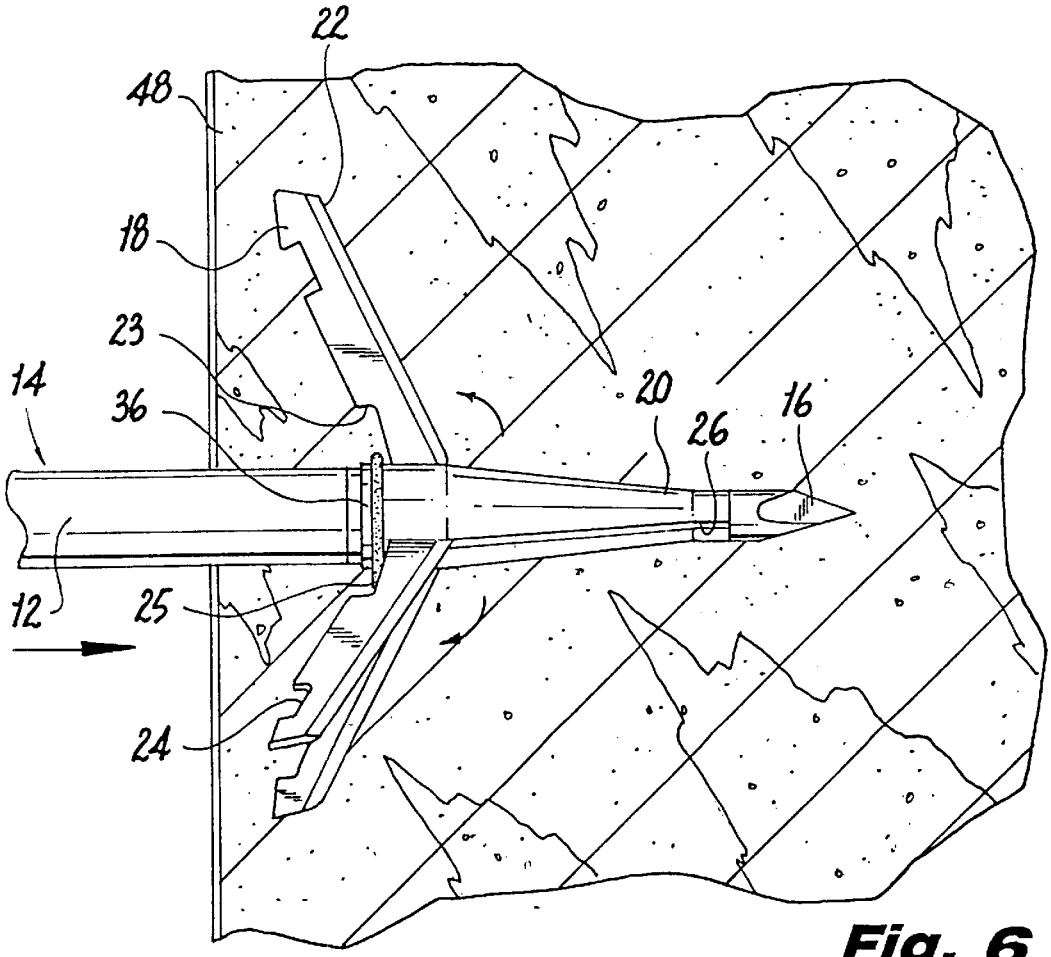
Fig. 6

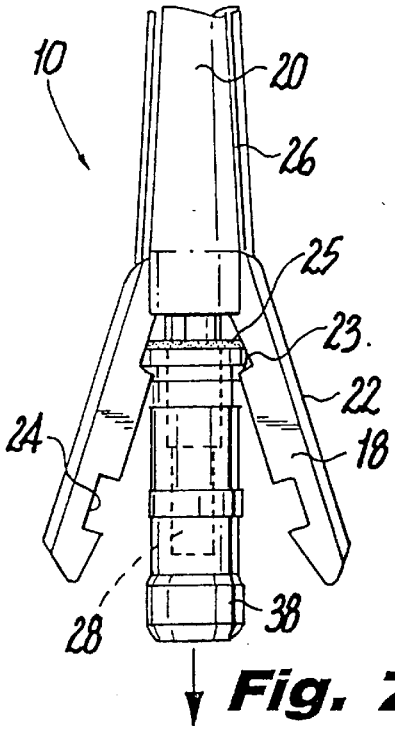
Fig. 7
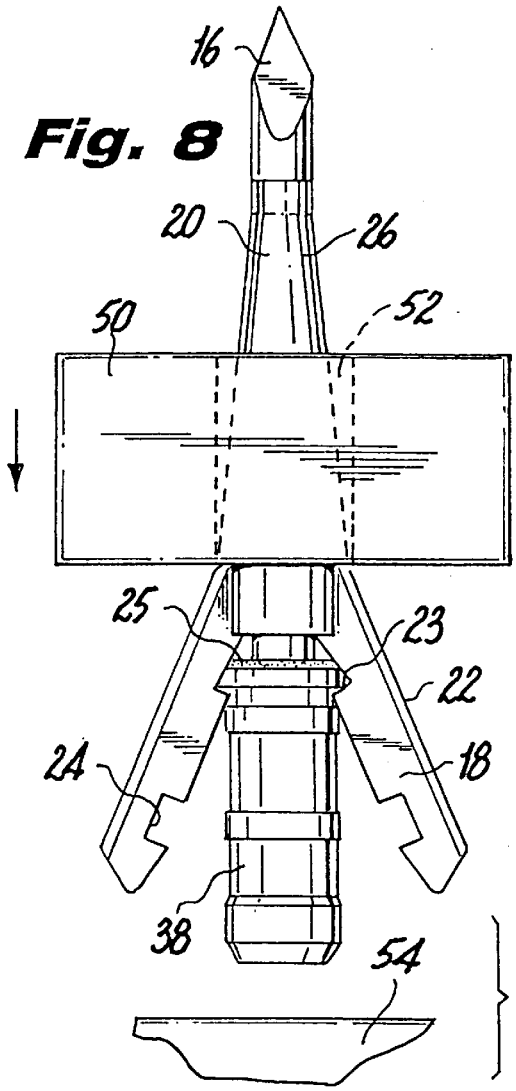
Fig. 8
Fig. 9
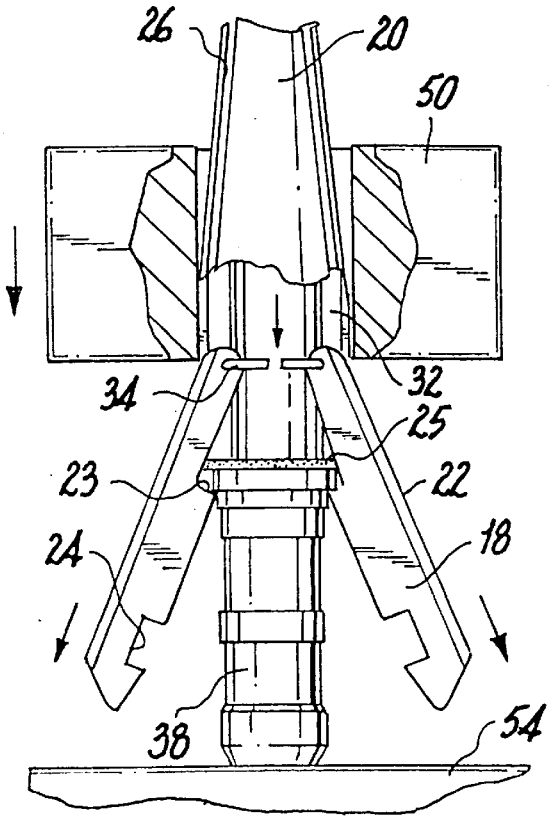
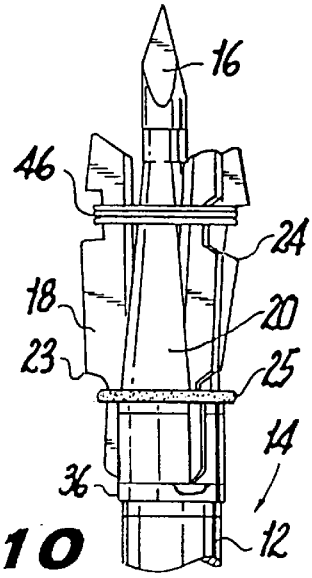
Fig. 10

BROADHEAD FOR AN ARROW HAVING EXPANDING CUTTING BLADES

BACKGROUND OF THE INVENTION

1. Field of the Invention

The present invention relates to a broadhead for an arrow having expanding cutting blades and, more particularly, to a broadhead having cutting blades which are held in an undeployed retracted position and moved to a deployed expanded position when the broadhead strikes a target.

2. Description of the Prior Art

Broadheads having cutting blades which are held in an undeployed retracted position and moved to a deployed expanded position when the arrow strikes a target are well known in the art. Broadheads designed with deployable cutting blades overcome the problems associated with wind drag and other adverse wind effects during the flight of the arrow. For example, U.S. Pat. No. 5,112,063 to Puckett discloses a broadhead having deployable cutting blades which are kept in a retracted position during the flight of an arrow by a tubular external restraint which fits over the ferrule of the broadhead. When the broadhead impacts against a target, such as an animal, a deployment mechanism causes the blades to be deployed, cutting the tubular restraint from the ferrule.

Various means for securing the expanding cutting blades to the ferrule of the broadhead have been developed in an effort to provide an aerodynamically balanced arrow with the capability of instantaneously deploying the cutting blades upon the arrow striking the target. Pivotable connecting pins are typically utilized for securing expanding cutting blades to the broadhead as disclosed in, for instance, U.S. Pat. No. 3,600,835 to Hendricks, U.S. Pat. No. 4,099,720 to Zeren, and U.S. Pat. No. 5,090,709 to Johnson, among others. Many other prior art broadheads provide pivotably connecting pins linking the expanding cutting blades to a plunger mechanism which causes the blades to deploy once the arrow strikes the target. These are disclosed in, for instance, U.S. Pat. No. 5,102,147 to Szeluga, and U.S. Pat. No. 5,112,063 to Puckett, among others.

The broadhead is typically secured to an arrow shaft via a threaded end portion of the broadhead. The threaded end portion may be threaded directly into the end of the arrow shaft. However, it is more common for the threaded end portion to be threaded into an insert which is secured within the end of the arrow shaft. A round flat washer is typically placed over the threaded end portion of the broadhead prior to joining the broadhead with the arrow shaft. In either case, either the washer or the end of the arrow shaft forms a shoulder which restrains the blades of the broadhead from deploying past a fixed point (i.e., the edge of the shoulder).

The shoulders formed by the structure associated with prior art broadheads and arrow shafts cause several disadvantages which may affect the performance of the arrow during use. For example, the edge of the shoulder puts stress on a single point of the blades which increases the possibility that a blade will crack upon impact with a hard surface, such as a bone of an animal. Also, the shoulder prevents blades from deploying in a further retracted position which may limit the penetration of the broadhead into the intended target.

The novel configuration of the washer used in connection with the broadhead of the present invention obviates the disadvantages encountered in the prior art by providing a means for distributing the stress exerted by the washer over a larger surface area of the blades while allowing the blades to deploy in a further retracted position.

SUMMARY OF THE INVENTION

The present invention provides a broadhead for an arrow having a reduced amount of interference in the pivotal range of travel of the cutting blades, thereby allowing the cutting blades to pivot to a predetermined deployed position which is further than prior art blades are able to deploy.

In a first embodiment, the broadhead generally includes a body portion having a circular cross-section and defining a proximal end and a distal end, a post member extending from the proximal end having an outer diameter less than an outer diameter of the body portion, and an outer peripheral surface protruding from the proximal end concentrically about the post member thereby defining a circular gap between the outer peripheral surface and the post member; a pointed tip at the distal end of the body portion; at least one cutting blade secured to the body portion and configured to be movable from a retracted position to an expanded position; and a washer configured to be positioned over the post member and adjacent the outer peripheral surface, the washer having at least one chamfer formed thereon.

In a second embodiment, the broadhead generally includes a body portion having a circular cross-section and defining a proximal end and a distal end, a post member extending from the proximal end having an outer diameter less than an outer diameter of the body portion; a pointed tip at the distal end of the body portion; a plurality of cutting blades secured to the body portion and configured to be movable from a retracted position to an expanded position; and a washer configured to be positioned over the post member and adjacent the outer peripheral surface, the washer having a plurality of chamfer formed thereon and aligned with the plurality of cutting blades.

Alternatively, where a washer is not utilized, an insert or an end of an arrow shaft, within which the first end portion of the body member is inserted, may be chamfered to reduce the amount of interference in the pivotal range of travel of the cutting blades, thereby allowing the cutting blades to pivot to a predetermined deployed position.

A retaining means, such as an elastic o-ring, may be secured around the cutting blades and fit into a notch on each cutting blade to maintain the cutting blades in an undeployed retracted position. The retaining means is disengaged from the notches when the broadhead strikes a target due to the force exerted by the target on the portion of the cutting blades partially extending from the slots. As a result, the cutting blades move into a deployed expanded position causing the area of impact on the target to be enlarged.

A second retaining means, such as a wire or string, may be secured around the cutting blades and fit into a second notch on each cutting blade to hold the cutting blades in an undeployed position so that the broadhead may be utilized as a target point if desired.

BRIEF DESCRIPTION OF THE DRAWINGS

For a better understanding of the invention, reference is made to the following description of exemplary embodiments thereof, and to the accompanying drawings, wherein:

FIGS. 5 and 6 illustrate the movement of the cutting blades from an undeployed retracted position to a deployed expanded position as the arrow strikes a target;

FIGS. 7–9 illustrate a method for removing the cutting blades from the broadhead of the present invention;

FIG. 10 illustrates a side view of the broadhead in the undeployed position with the blades secured for use of the broadhead as a target point;

DETAILED DESCRIPTION OF PREFERRED EMBODIMENTS

Figure 1:
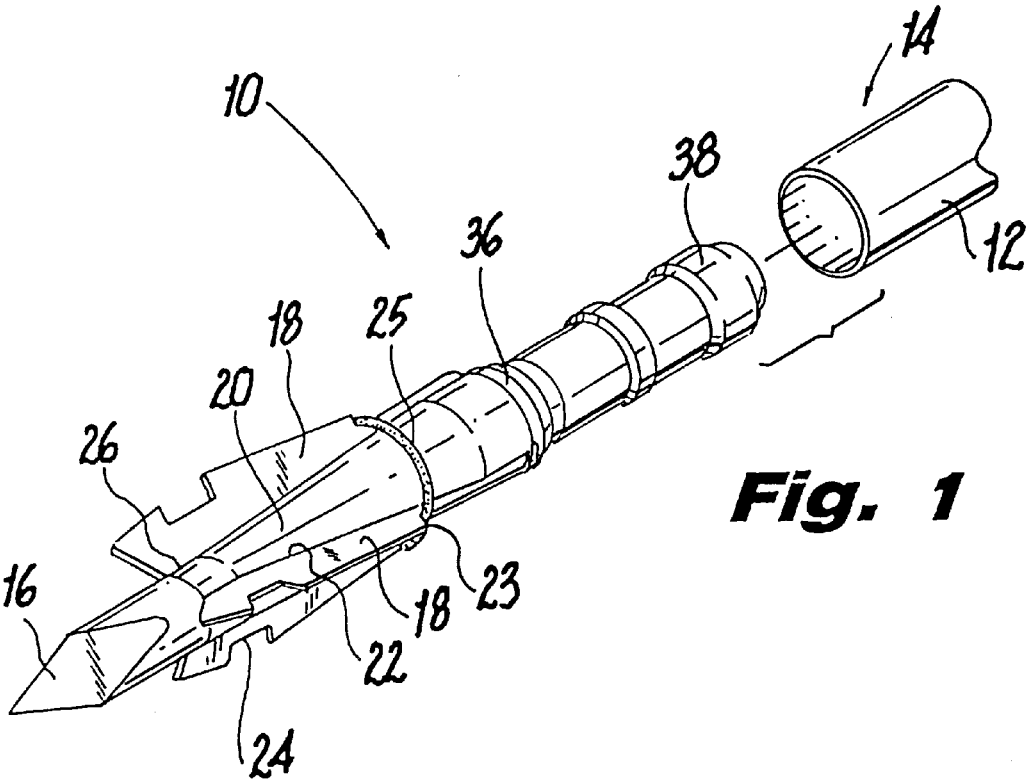
FIG. 1 illustrates a perspective, partially exploded view of an arrow having the broadhead of the present invention secured to an insert for assembly to the arrow shaft, with the cutting blades in the undeployed retracted position.

Referring now in specific detail to the drawings, in which like reference numerals identify similar or identical elements throughout the several views, FIG. 1 illustrates an exploded view of a broadhead 10 of the present invention secured to a shaft 12 of an arrow 14. Broadhead 10 includes a pointed tip 16 and cutting blades 18 attached to a tapered body portion 20. Cutting blades 18 include a cutting edge 22 and a notch 23 on a side opposite the cutting edge 22. The blades are secured to broadhead 10 by a securement mechanism and maintained in an undeployed retracted position by an elastic ring 25 which engages the notch 23 of each cutting blade 18. A second notch 24 is formed in each cutting blade 18 to facilitate utilizing broadhead 10 as a target point as further discussed below.

As used herein, the term "proximal end" refers to the end of the broadhead which attaches to the arrow shaft, and the term "distal end" refers to the pointed tip end of the broadhead.

Figure 2:
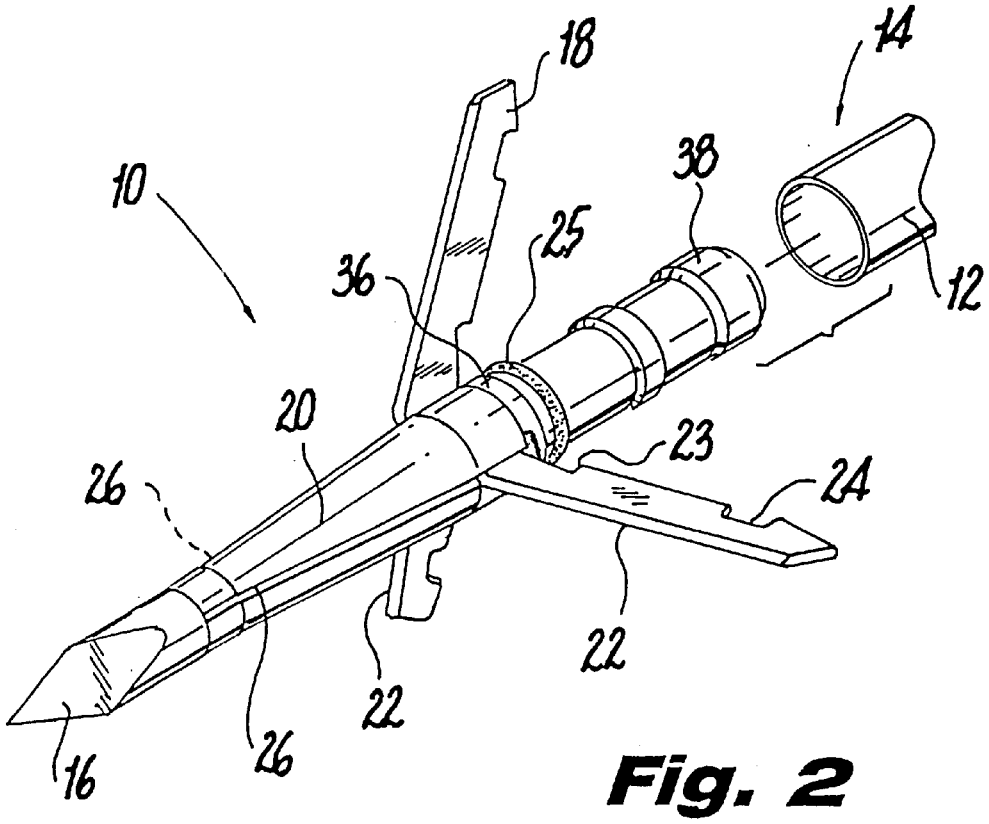
FIG. 2 illustrates a perspective, partially exploded view of the arrow of FIG. 1 having the broadhead of the present invention with the cutting blades in the expanded position.

As best seen in FIG. 2, slots 26 extend along a major portion of a longitudinal axis of tapered body portion 20 for partially inserting expanding cutting blades 18 while in the undeployed retracted position. Broadhead 10 may be secured to the arrow shaft 12 by cylindrical insert 38 as described below, by a locking mechanism as disclosed in U.S. Pat. No. 5,354,068, the contents of which are incorporated herein by reference, or by any other means known to one having ordinary skill in the art. FIG. 2 illustrates the broadhead of the present invention in which the elastic ring 25 has been moved proximally along the cutting blades 18 as the blades moved toward a deployed expanded position.

Figure 4:
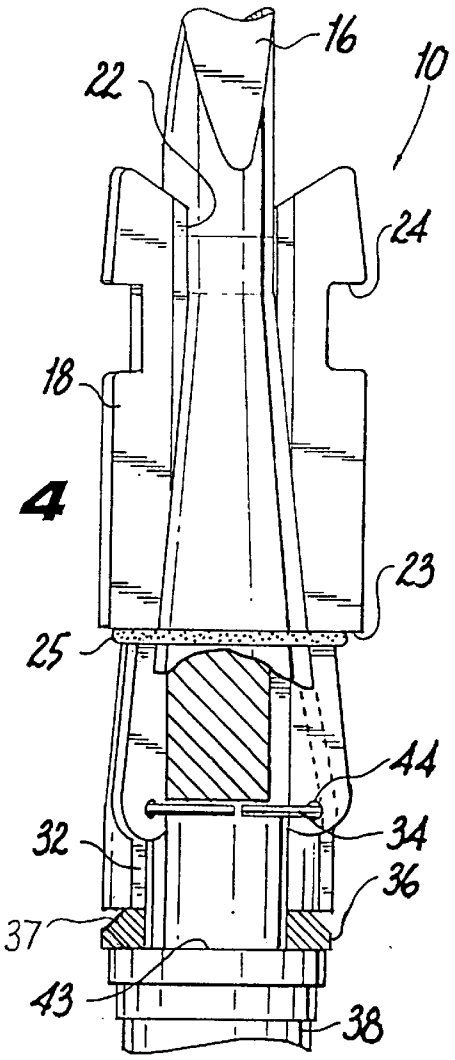
FIG. 4 illustrates a side-view in partial cross-section of the assembled broadhead and novel washer design.
Figure 3:
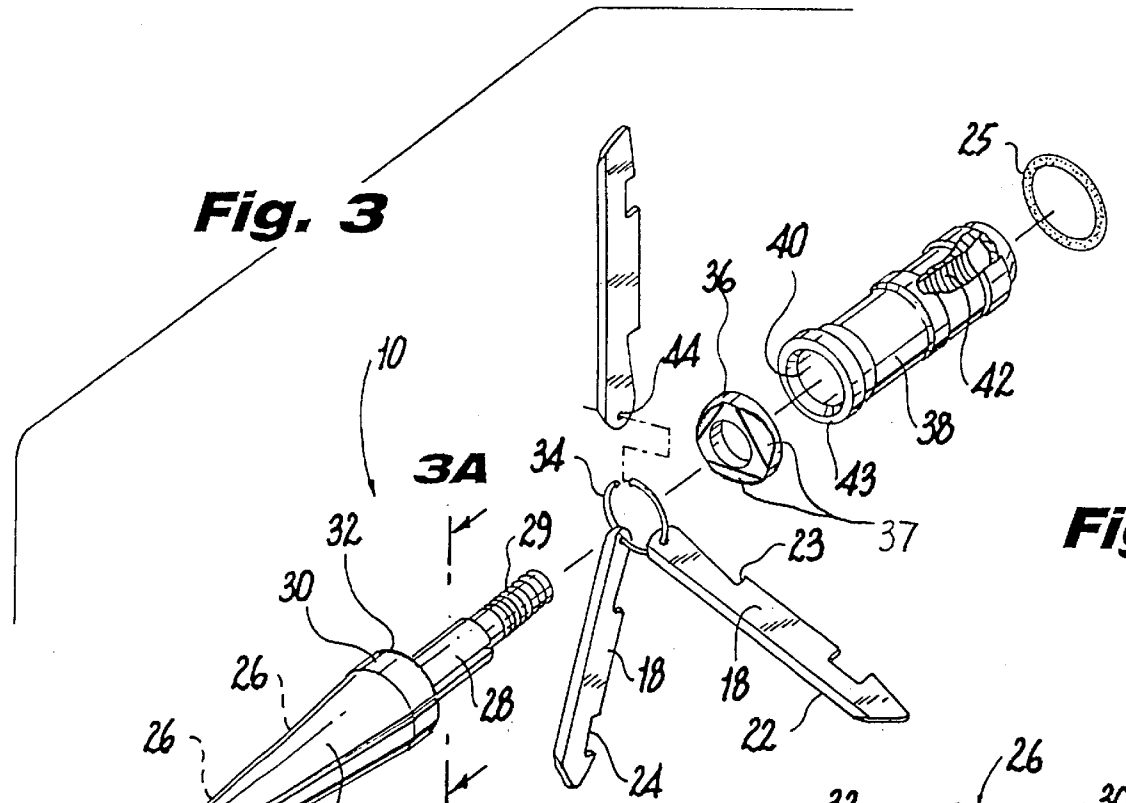
FIG. 3 illustrates an exploded view of the broadhead of the present invention showing its novel washer design.
Figure 3A:
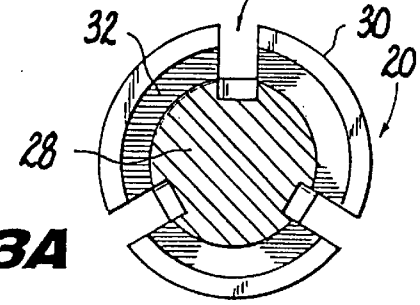
FIG. 3*a* is a cross section of the broadhead of the present invention taken along line 3*a*—3*a* of FIG. 3.

FIG. 3 illustrates the assembly of the cutting blades 18 to broadhead 10, and FIG. 4 illustrates a cross-section of the fully assembled broadhead 10. As seen in FIG. 3, pointed tip 16 is frictionally fit, threaded or press fit in a conventional manner onto a distal first end of tapered body portion 20 of broadhead 10. A post member 28 having a smaller diameter than the outer diameter of tapered body 20 extends proximally from the tapered body portion 20 at an end opposite the first end and pointed tip 16. The post member 28 includes a threaded portion 29 for facilitating connection of broadhead 10 to shaft 12 as further described below. A circular wall 30 also extends from the end opposite the pointed tip 16, specifically from the outer peripheral surface of tapered body portion 20. A circular gap 32 is thus formed between circular wall 30 and post member 28, as illustrated in FIG. 3*a*.

The mechanism for securing cutting blades 18 to broadhead 10 comprises a ring 34 for holding the cutting blades 18 as a single replaceable ring/cutting blade assembly within the circular gap 32. A washer 36, and a cylindrical insert 38, which is insertable into the end of arrow shaft 12 as shown in FIG. 1, lock the ring/cutting blade assembly in position. Each cutting blade 18 includes a hole 44 at one end for coupling with ring 34 to form the ring/cutting blade assembly. It is also contemplated that blades 18 may be pivotally attached to broadhead 10 by a pin or other means known to one having ordinary skill in the art.

To secure the expanding cutting blades 18 to the broadhead 10, the ring/cutting blade assembly is first placed over the post member 28 and the cutting blades 18 are aligned with the slots 26. The alignment of the cutting blades 18 within the slots 26 also aligns the cutting blades 18 with the longitudinal axis of the broadhead 10, since the slots 26 are properly aligned with the longitudinal axis of the tapered body portion 20 during the manufacture of the broadhead 10. This obviates the requirement for exact precision measurements present in the assembly of broadheads while providing a precise alignment of the cutting blades 18 with the longitudinal axis of the broadhead 10, which ensures that the assembled broadhead 10 will be properly balanced for accuracy in flight. It is also contemplated that slots 26 may be formed in such a manner as to be out of alignment with the longitudinal axis of broadhead 10.

After the ring/cutting blade assembly is placed over post member 28, washer 36 is then placed over post member 28. The washer 36 is typically constructed of a hardened steel or similar material, to facilitate the forcing of the ring cutting blade assembly into position within circular gap 32 as will be described below. The ferrule, blade and washer assembly are then joined to an arrow, as illustrated in FIGS. 1 and 4, having the cylindrical insert 38 in place on the distal end of the arrow shaft 12. Insert 38 includes a central bore 40 having an internal threaded portion 42. While the cutting blades 18 are held within their respective slots 26, the insert 38 and arrow shaft 12 are rotated so that the threaded portion 29 of the post member 28 engages the internal threaded portion 42 of the cylindrical insert 38.

As insert 38 and arrow shaft 12 are rotated onto post member 28, the distal end 43 of insert 38 engages washer 36, forcing washer 36 to move distally towards tapered body portion 20. As the cylindrical insert 38 and arrow shaft are further rotated, washer 36 contacts the proximal ends of cutting blades 18 near the area where ring 34 is attached to each cutting blade 18. The washer 36 applies pressure to the cutting blades 18 forcing ring 34 to compress slightly and become wedged in circular gap 32 formed between post member 28 and circular wall 30 extending from tapered body portion 20, thereby firmly securing the ring/cutting blade assembly to the broadhead 10. While the washer 36 facilitates the forcing of ring 34 into circular gap 32, it may be eliminated, and the distal end 43 of insert 38 may be utilized to force ring 34 distally. In this case, the material of which the insert 38 is constructed may be steel or a material of like hardness.

The elastic o-ring 25 engages notch 23 on each cutting blade 18 for maintaining cutting blades 18 at least partially within slots 26 while cutting blades 18 are in an undeployed retracted position. The elastic o-ring 25 disengages the notches 23 when the arrow 14 strikes a target 48, as seen in FIGS. 5 and 6, to enable the cutting blades 18 to move into a deployed expanded position as explained below.

It is also contemplated that the cylindrical insert 38 may be provided without a threaded portion 42 and be constructed of a material that is self-tapping, such as aluminum. Rotation of the aluminum insert 38 over the post member 28 would cause the threaded portion 29 of the post member 28 to create internal threads on the inner surface of cylindrical insert 38. In addition, it is further contemplated that the threads may be eliminated in both the post member 28 and the shaft 38, so that post member 28 is forced into the central bore 40, and is held in place through the use of, for example, a raised detent.

When the arrow 14 strikes a target 48, the pointed tip 16 of the broadhead 10 pierces the target 48 as illustrated in FIG. 5. As the arrow 14 continues to penetrate the target 48, the area immediately surrounding the point of entry makes contact with the portion of the cutting blades 18 partially extending from the slots 26. The force applied by the target 48 on the cutting blades 18 causes the blades 18 to move in a direction opposite the target 48. This motion causes the elastic ring 25 to be forced rearwardly and disengage the notches 23, to enable the cutting blades 18 to move into a deployed expanded position as illustrated in FIG. 6. The expanded cutting blades 18 thus cut and enter the target 48 causing the area of impact to be enlarged.

The range of travel of cutting blades 18 is, however, limited by washer 36 (or by the end of insert 38 when the washer 36 is not used). As discussed above, in prior art broadheads, washer 36 was manufactured in the shape of a common flat washer. Therefore, the range of travel of each cutting blade 18 was limited to the point where cutting blades 18 were only being deployed to a position which was slightly beyond perpendicular to the longitudinal axis of broadhead 10. More specifically, cutting blades 18 could only deploy to a point where the back of the blade hits the edge of washer 36. In the fully deployed position, cutting blades 18 contact and rest upon a hard edge of washer 36.

Figure 11:
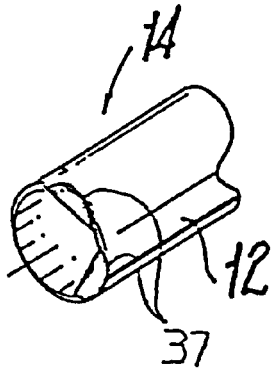
FIG. 11 illustrates a perspective view of the end of an arrow shaft having a chamfered surface.
Figure 12:
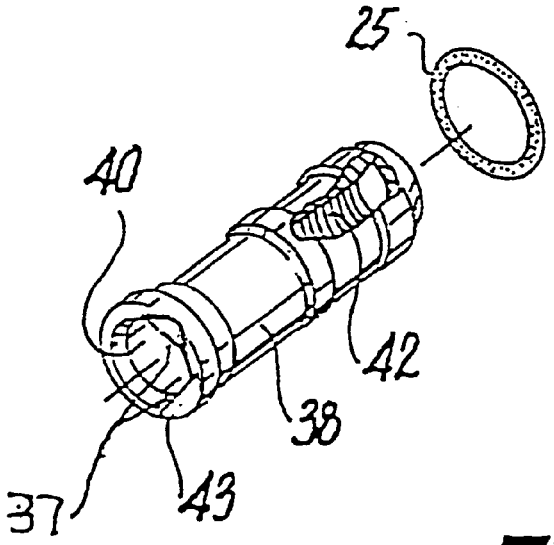
FIG. 12 illustrates a perspective view of an insert having a chamfered surface.

To allow cutting blades 18 to deploy further in the proximal direction than the prior art broadheads would allow, washer 36 of the present invention includes chamfers 37 on washer 36 (as best illustrated in FIGS. 3 and 4). The number of chamfers 37, and spacing therebetween, corresponds to the number and spacing of cutting blades 18 in the broadhead. In accordance with the present invention, in the fully deployed position, cutting blades 18 will rest on the chamber surface rather than a hard edge of a regular washer used in the prior art broadhead assemblies. Chamfers 37 are preferably formed by machining or grinding an edge of a common flat washer at predetermined locations. It is also contemplated that a chamfered surface 37 may be formed on an end of an arrow shaft 12 or on an insert 38 as shown in FIGS. 11 and 12, respectively.

To utilize broadhead 10 as a target point, blades 18 can be prevented from deploying by being tied to the broadhead 10 as illustrated in FIG. 10. Specifically, a string or wire 46, or the like, is used to tie cutting blades 18 to the broadhead 10 by winding the string 46 around the distal notch 24 on each cutting blade. In this configuration the cutting blades 18 will be held in the undeployed position when the broadhead 10 strikes the target 48, such that the broadhead 10 may be utilized as a target point.

FIGS. 7–9 illustrate a method for removing cutting blades 18 from the broadhead 10 of the present invention. For simplicity, the arrow shaft has been eliminated from the drawings. First, as shown in FIG. 7, the broadhead 10 is partially removed from insert 38 by partially unthreading post member 28. The elastic ring 25 is disengaged from the notches 23 enabling the cutting blades 18 to swing towards the insert 38. As shown in FIG. 8, tapered body portion 20 of the broadhead 10 is placed against a block 50, preferably having a cylindrical bore 52, although any surface having a bore will suffice. The bore 52 preferably is narrower than the cross section of the cutting-blade assembly, thus preventing the cutting blades 18 from entering the bore 52. The end of the arrow shaft, or insert 38, is then placed over a hard, durable surface 54, as illustrated in FIG. 9. The block 50 is pushed toward the surface 54 causing pressure to be applied to each cutting blade 18 at a point near where the ring 34 is connected to each cutting blade 18. This action also causes pressure to be applied to the ring 34 in a direction opposite the pointed tip 16. The pressure disengages the ring 34 from the circular gap 32. The insert 38 is then fully unthreaded and the broadhead 10 is removed, which enables the removal of the ring cutting blade assembly. A new set of cutting blades 18 with their associated ring 34 can then be placed over the post member 28 and secured to the broadhead 10 as a single replaceable unit as described above. Alternatively, tapered body portion 20 may be placed on a surface having a bore, and the arrow shaft may be used to push downwardly on the broadhead 10 whereby the blades 18 are forced proximal to the tip 16 for removal.

Although the illustrative embodiments of the present invention have been described herein with reference to the accompanying drawings, it is to be understood that the invention is not limited to those precise embodiments, and that various other changes and modifications may be affected therein by one having ordinary skill in the art without departing from the scope or spirit of the invention. All such changes and modifications are intended to be included within the scope of the invention as defined by the appended claims.

What is claimed is:

1. A broadhead for an arrow comprising:

a body portion having a circular cross-section and defining a proximal end and a distal end, and a post member extending from the proximal end having an outer diameter less than an outer diameter of the body portion;

a pointed tip at the distal end of said body portion;

at least one cutting blade secured to said body portion and configured to be movable from a retracted position to an expanded position; and a washer configured to be positioned over said post member and adjacent said proximal end of said body portion, said washer having at least one chamfer formed thereon for contacting said at least one cutting blade in said expanded position.

2. A broadhead for an arrow as recited in claim 1, wherein an insert is placed within a hollow end of an arrow shaft of said arrow, said insert and said post member including threaded portions for threadedly engaging said threaded portion of said insert to said threaded portion of said post member for securing said broadhead to said arrow.

3. A broadhead for an arrow as recited in claim 2, wherein said washer is placed over said post member and adjacent said insert.

4. A broadhead for an arrow as recited in claim 1, wherein said body portion includes at lea st one slot extending along at least a portion of the length of said body portion for at least partially accepting said at least one cutting blade when said cutting blade is in said retracted position.

5. A broadhead for an arrow as recited in claim 1, further comprising retaining means positioned within a notch formed on a side opposite a cutting edge of said at least one cutting blade for maintaining said at least one cutting blade in said retracted position.

6. A broadhead for an arrow as recited in claim 5, wherein said retaining means is an elastic ring.

7. A broadhead for an arrow as recited in claim 5, wherein said at least one cutting blade is movable to said expanded position when said retaining means is removed from said notch.

8. A broadhead for an arrow as recited in claim 1, further comprising a ring for holding said at least one cutting blade, said ring and said at least one cutting blade forming a cutting blade assembly, said ring configured to be insertable within a circular gap defined by an outer peripheral surface of said body portion extending proximally and concentrically about said post member to secure said cutting blade assembly to said body portion.

9. A broadhead comprising:

a body member having a first end portion and a second end portion;

a pointed tip at a distal end of said second end portion of said body member;

at least one cutting blade pivotally secured to the body member between an open and closed position; and a washer positioned on said first end portion of said body member adjacent a proximal end of said first end portion of said body member, said washer having at least one chamfer for contacting said at least one cutting blade when said blade is in an open position.

10. A broadhead as recited in claim 9, further comprising a ring member for retaining said at least one cutting blade, said ring member being insertable into a circular gap formed about said first end portion by an outer peripheral surface protruding from a proximal end of said first end portion of the body member to secure the at least one cutting blade to the body member.

11. A broadhead as recited in claim 10, wherein said ring member is compressible to fit into the circular gap.

12. A broadhead as recited in claim 9, wherein the first end portion of said body member includes a post member, said post member having a diameter less than an outer diameter of the second end portion of the body member.

13. A broadhead as recited in claim 9, wherein the body member includes at least one longitudinally directed slot corresponding in number to said at least one blade, such that at least a portion of said at least one blade fits into said slot.

14. A broadhead as recited in claim 9, further comprising means for retaining the at least one blade in the closed position, said retaining means being disengagable upon impact to permit pivoting of said at least one blade to the deployed position.

15. A broadhead comprising:

a body member having a first end portion and a second end portion;

a pointed tip at a distal end of said second end portion of said body member;

a plurality of cutting blades pivotally secured to the body member between a deployed and non-deployed position; and a chamfered surface disposed at a proximal end of the first end portion of the body member to contact said plurality of cutting blades in said deployed position to allow the plurality of cutting blades to pivot to a predetermined deployed position;

wherein said chamfered surface is disposed on a washer positioned at a proximal end of the body member.

16. A broadhead comprising:

a body member having a first end portion and a second end portion;

a pointed tip at a distal end of said second end portion of said body member;

a plurality of cutting blades pivotally secured to the body member between a deployed and non-deployed position; and a chamfered surface disposed at a proximal end of the first end portion of the body member to contact said plurality of cutting blades in said deployed position to allow the plurality of cutting blades to pivot to a predetermined deployed position;

wherein said chamfered surface is disposed on an insert positioned at a proximal end of the body member.

17. A broadhead comprising:

a body member having a first end portion and a second end portion;

a pointed tip at a distal end of said second end portion of said body member;

a plurality of cutting blades pivotally secured to the body member between a deployed and non-deployed position; and a chamfered surface disposed at a proximal end of the first end portion of the body member to contact said plurality of cutting blades in said deployed position to allow the plurality of cutting blades to pivot to a predetermined deployed position;

wherein said chamfered surface is disposed on an end of an arrow shaft to which said broadhead is secured.

* * * * *